US008990977B2

(12) United States Patent
Clay et al.

(10) Patent No.: US 8,990,977 B2
(45) Date of Patent: Mar. 31, 2015

(54) PATIENT MOVEMENT SUPPORT DEVICE AND METHOD

(71) Applicants: Lois Clay, Clear Lake, WA (US); Carmal Arnold, Clear Lake, WA (US)

(72) Inventors: Lois Clay, Clear Lake, WA (US); Carmal Arnold, Clear Lake, WA (US)

( * ) Notice: Subject to any disclaimer, the term of this patent is extended or adjusted under 35 U.S.C. 154(b) by 0 days.

(21) Appl. No.: 13/762,518

(22) Filed: Feb. 8, 2013

(65) Prior Publication Data

US 2013/0227781 A1 Sep. 5, 2013

Related U.S. Application Data

(60) Provisional application No. 61/606,774, filed on Mar. 5, 2012.

(51) Int. Cl.

| | |
|---|---|
| ***A61G 7/05*** | (2006.01) |
| ***A61G 7/053*** | (2006.01) |
| ***A61G 7/075*** | (2006.01) |
| *A61G 13/12* | (2006.01) |

(52) U.S. Cl.

CPC ..... *A61G 7/05* (2013.01); *A61G 13/125* (2013.01); *A61G 7/0536* (2013.01); *A61G 7/0755* (2013.01)

USPC ..... 5/81.1 R

(58) Field of Classification Search

CPC ..... A61G 7/05; A61G 7/0536; A61G 7/0755; A61G 13/125

USPC ..... 5/651, 81.1 R, 646

See application file for complete search history.

(56) References Cited

U.S. PATENT DOCUMENTS

| | | | | |
|---|---|---|---|---|
| 1,539,082 | A * | 5/1925 | Fyler | 5/651 |
| 5,996,144 | A | 12/1999 | Hodgetts | |
| 6,003,172 | A | 12/1999 | Gonzalez | |
| 6,260,221 | B1 * | 7/2001 | Grabell et al. | 5/648 |
| 6,349,432 | B1 | 2/2002 | Scordato | |
| 7,305,726 | B2 | 12/2007 | Augustine | |
| 7,540,043 | B2 | 6/2009 | Stackley | |
| 2004/0133984 | A1 * | 7/2004 | Mahoney et al. | 5/651 |
| 2008/0016618 | A1 | 1/2008 | O'Shea | |
| 2010/0101025 | A1 * | 4/2010 | Corallo | 5/651 |

* cited by examiner

*Primary Examiner* — Peter M Cuomo
*Assistant Examiner* — Brittany Wilson
(74) *Attorney, Agent, or Firm* — Daniel Boudwin; Global Intellectual Property Agency LLC

(57) ABSTRACT

A push board device and method of use is disclosed for supporting an individual's lower body while the patient is in a prone position and exerting force on the device to slide along a bed surface. The device comprises a lower leg press member attached to an elongated board member, where the board connects to the side rails of a patient bed and the leg press member provides a location for which the patient to support themselves during sliding movement. Embodiments of the leg press member include a solid, rounded member or a tubular member having an open interior to provide storage for a low friction sliding sheet therein. The board member is positioned between two side rails of a hospital bed or similar structure to allow the user to securely push against the device. The low friction sheet assists in movement of an individual and reduces resistance.

8 Claims, 2 Drawing Sheets

PATIENT MOVEMENT SUPPORT DEVICE AND METHOD

CROSS REFERENCE TO RELATED APPLICATION

This application claims the benefit of U.S. Provisional Application No. 61/606,774 filed on Mar. 5, 2012, entitled "Push-N-Scoot Wellness Bed Kit." The patent application identified above is incorporated here by reference in its entirety to provide continuity of disclosure.

BACKGROUND OF THE INVENTION

1. Field of the Invention

The present invention relates to exercise supports and push board devices. More specifically, the present invention pertains to a portable push board support that is adapted for use in conjunction with bed side rails to aid in movement along a surface.

It is common for hospital patients to experience difficulty moving within a bed or mobilizing to exit a bed because of illness, injury, or weakness. This can cause the patient to have issues moving around the bed's surface or trouble transferring out of the bed. An effective solution is generally to have an able-bodied individual assist the patient moving from a prone position to another desired position within the bed, or further to assist the patient when sitting up or exiting the bed. However, relying on third parties for assistance can be problematic if the patient is not in a healthcare facility or otherwise not diligently looked after. Relying on others also is not conducive to building physical strength in the patient, and further physically assisting another can introduce a safety risk for frail patients. The assistant is limited by his or her own physical ability and the attempt to safely move the patient can have unforeseen risks that may injure the patient. The chance of injury may increase when an assistant, for example a family member, is not properly trained to properly move or handle the patient during the transfer.

Modern hospital beds have inadequacies in their design as it relates to transferring or moving patients. Most hospital beds do not have sufficient features to aid a patient when repositioning within the bed, transferring therefrom, or exercising while in a prone position to build strength. In general, the patient can only attempt to adjust himself on the bed with the use of the side rail, which relies upon the patient's upper body strength to assist movement within the bed. A more able bodied patient would be able to use an overhead trapeze support element, if available; however this element is not always provided and further relies solely on the patient's upper body as a means to move within the bed. The limitations of hospital beds imposed on the movement of patients require a solution that incorporates the lower body of the user, whereby the user's lower body can be supported during a movement within the bed, whether for comfort, patient transfer, or general exercise and strength building movement.

The present invention is a new and improved hospital bed support device that offers a patient the ability to push against the device when engaging in bed movement while in a prone position. In this way, the device functions as a push board support device, supporting the lower body of a patient as they press their feet thereagainst while attempting to slide within the bed. The device allows for unassisted lateral movement along the bed surface, while the device further provides storage for a low friction sheet that can be placed under the patient if desired to further facilitate movement. The device comprises a leg press member attached to an elongated board that is placed across the bed between opposing bed side rails. In one embodiment, the leg press member comprises a hollow, elongated tube with a first end and second end. The first end of the elongated tube is open to allow for storage of the low friction sheet. The leg press member attaches to a parallel board, whereby the board extends outwardly in equal length beyond the extents of the member to engage upstanding bed rails and receive stable support therefrom. When in use, the push board support is firmly secured between side guard rails of the bed and the user engages the foot press member with both feet to support sliding movement along the bed surface. To prevent bunching of the patient with the bed fitted sheet, the low friction surface can be positioned under the patient during installation of the present board device.

2. Description of Prior Art

Devices have been disclosed in prior art that relate push board supports. These include devices that have been patented and published in patent application publications, and generally relate to caretaker-assisted movement devices having conveyance means or other diverging elements as it relates to the present invention. The devices deemed most relevant to the present disclosure are herein described for the purposes of highlighting and differentiating the unique aspects of the present invention, and further highlighting the drawbacks existing in the prior art.

Specifically, to U.S. Pat. No. 7,540,043 to Stackley describes a conveyor assembly to transfer a person from a first surface to a second surface. The assembly comprises a frame attached to rollers surrounded by a conveyor belt that moves by way of a power source. The power source is coupled to a roller and allows the Stackley device to rotate the surrounding belt along the first surface towards a second surface. The Stackley device is operated while a person lies upon the top surface of the device. Once the person is on the device, the power source is activated and causes the rollers to rotate. The rotation causes the Stackley device to move in the direction of the second surface thereby transferring the person to the second surface. The Stackley device is a motorized means of assisting in transport of a patient from one surface to another. The present invention contemplates a static support device that affixes to the side rails of a bed to allow a patient to assist themselves without the use of any motorized input.

Another assembly is U.S. Pat. No. 5,996,144 to Hodgetts. This assembly transports a person from a bed to a stretcher, or vice versa. The assembly comprises a bed sheet, conveyor, and a connection means to the bed. The conveyor comprises a roller with bearings, and a connection means to the bed sheet. Hodgetts device is connected to the bed where the patient the patient will be moved. The connected sheet is placed onto stretcher where the patient lies. To operate the device, a person rotates the conveyor. This allows the patient to move from the first surface to the second surface. The use of the Hodgetts device presents practical limitations. First, the Hodgetts device requires multiple points for the connection means to attach to the sheet. This is an issue because fewer connections with the sheet to the conveyor can result in a rip or tear of the sheet. Further, the design of the Hodgetts device requires the bed and stretcher transfer surfaces to be near parallel in order to be effectively used. The present invention provides a simplified me of movement within a single bed, as opposed to a conveyance means between beds. While both the Hodgetts device and the present invention are related to patient movement, the present invention relies on patient input to move within the bed. The present invention also helps develop strength in the patient as the patient uses the push board device to shift within the bed, improving strength and overall health.

Another example of a patient transfer device is U.S. Pat. No. 6,003,172 to Gonzalez, which discloses a transfer sheet to move a person from first surface to a second surface. The device comprises a sheet of a flexible material. The sheet is placed midway between two surfaces. The person is placed on top of the sheet on while he or she lies upon the first surface. The person is then moved by another across the sheet onto the second surface. The Gonzalez device is very simple and has limitations. First, the Gonzalez device is a sheet used to create a level bridge-like connection between two surfaces. This can only be created between two parallel surfaces. This is an issue if, for example, two hospital beds are used for the transfer. The beds may have a large gap between them. This can cause the patient to fall between the surfaces if the sheet is not rigid enough to support the patient's weight. Also if the two surfaces are not parallel then any incline or decline between a transfer can be a problem. The individual may not be able to be pushed safely up the incline or down the decline. The present invention is not presented with these issues because the sheet of the present invention is used to move only on one surface.

A similar device is U.S. Pat. No. 6,349,432 to Scordato. This device is used to transfer a person lying on a first surface to a second surface. The device comprises two semi rigid low friction surfaces stacked upon each other. The upper surface has connection means to at least two straps. The Scordato device is placed onto the first surface. Then the person to be moved is placed onto the Scordato device. The person assisting pulls the straps on the upper surface. This moves the individual towards the second surface. The design of the Scordato device limits its use. First, the device requires a person be placed atop stacked surfaces. This can be difficult based on the mobility or health of the person to be moved. Second, the Scordato device prefers a decline between the first and second surface. This preference can be problematic to the patient if they are unable to bear the force of the quick drop. Another issue during the transfer can be made with two surfaces of equal height. Surfaces with equal heights may result in improper use of the Scordato. Since the present invention only requires one surface, it will not encounter any of these issues. Furthermore, the present invention needs only one low friction sheet surface between the individual and the bed for movement. This can be important for a patient who cannot be moved easily onto an elevated surface such as the Scordato device.

Finally, U.S. Pat. No. 7,305,726 to Augustine is an accessory transfer device for a wheelchair. The Augustine device is a modification to a wheelchair. It is a substitute for the arm rest section of the wheelchair. The Augustine device comprises a platform with multi-directional connection means to the wheelchair. When the device is not in use it functions as an arm rest for the wheelchair. However, if person in the wheelchair needs to be transferred to another seat, or vice versa, the device may be used to move the patient. The device moves downward to form a bridge to the second seat area. The patient is assisted as he or she moves to the second seat. This differs substantially from the present invention. The Augustine device is an attachment built into a wheelchair. Contrastingly, the present invention is a portable and removable device adapted for use with bed rails of a patient bed for supporting the lower body of a patient while moving within the bed or moving from the bed.

The present invention is a new and improved push board support that provides the user the ability to independently move along a bed surface, assist in transferring from a bed, and slowing help build patient strength by relying on patient lower body input for such movements. The present invention has been shown to both assist movement without third party input, while also improve patient health by building strength and providing an means of exercise for a bedridden and prone patient. The design of the device is a hollow, elongated tube attached to a board that spans the width of a patient bed and is supported by opposing bed side rails. A removable sheet from within the tube allows a low friction interface to be positioned below the patient to assist movement and reduce sheet bunching. In light of the devices in the prior art, it is submitted that the present invention substantially diverges in elements from the prior art, and consequently it is clear that there is a need in the art for an improvement to existing devices. In this regard the instant invention substantially fulfills these needs.

SUMMARY OF THE INVENTION

In view of the foregoing disadvantages inherent in the known types of push board supports now present in the prior art, the present invention provides a new lower body support device that works in conjunction with patient bed side rails to assistance a patient user when moving within a bed or assisting in transfer therefrom.

It is therefore an object of the present invention to provide a new and improved push board support device that has all of the advantages of the prior art and none of the disadvantages.

It is another object of the present invention to provide a push board support device that acts as a high stiffness support member that is placed between two opposing patient bed side rails, whereby a patient can forcibly push against the device when installed to engage his or her lower body when moving within the bed.

Another object of the present invention is to provide a push board support device that allows a patient to easily slide along a bed surface without third party assistance.

Another object of the present invention is to provide a push board support device that allows a patient to build strength and exercise by pressing against the board while in bed, increasing strength and improving overall health of the patient over time.

Yet another object of the present invention is to provide a push board support device that allows a patient assist themselves and caretakers when transferring from one bed to another, or when exiting the bed in general.

Another object of the present invention is to provide a storage area within the device, whereby the assembly comprises a hollow, elongated tube with an open first end having a removable cap such that articles can be stored therein.

Still yet another object of the present invention is to provide a low friction surface deployable from the push board device to assist in movement within the bed and prevent sheet bunching. The present invention incorporates a separate low friction sheet that offers a low friction interface that can be placed below a patient when sliding within the bed.

Another object of the present invention to provide push support device invention that is comprised of a sufficiently stiff and high strength material to allow a patient user to exert lower body forces against the device when engaging in movements within the bed.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
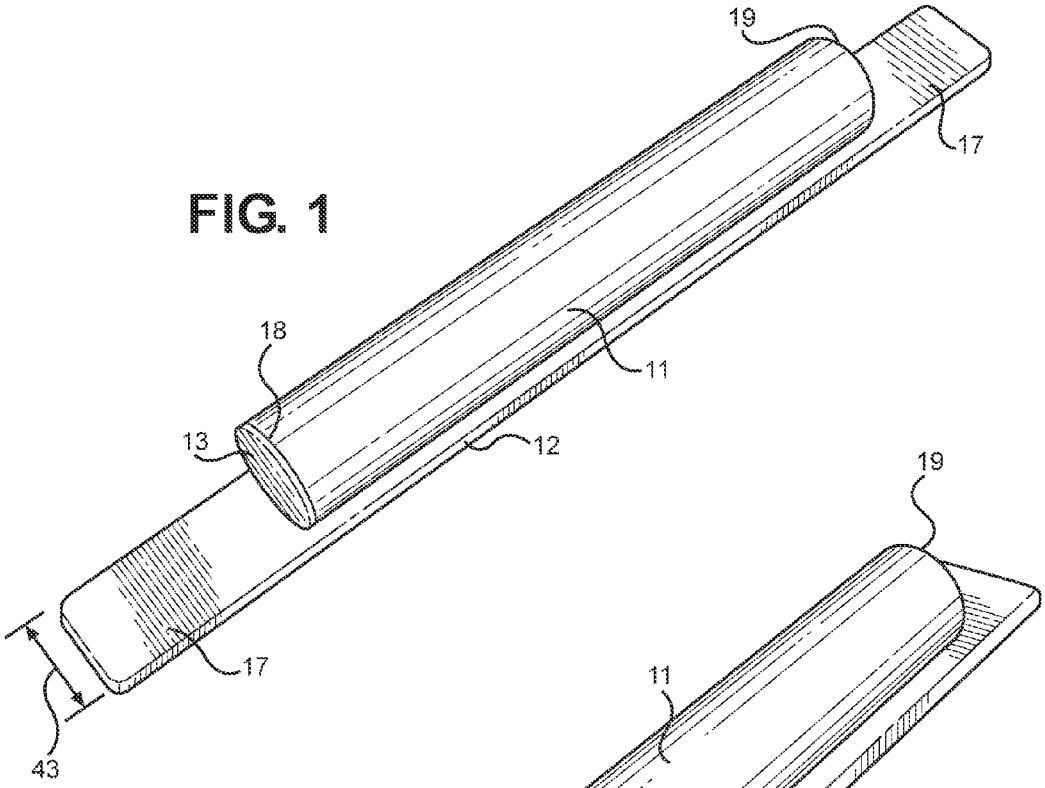
FIG. 1 shows an overhead perspective view of the preferred embodiment of the present invention.

Reference is made herein to the attached drawings. Like reference numerals are used throughout the drawings to depict like or similar elements of the push board support. For the purposes of presenting a brief and clear description of the present invention, the preferred embodiment will be discussed as used for the push board support. The figures are intended for representative purposes only and should not be considered to be limiting in any respect.

Referring now to FIG. 1, there is shown a perspective view of the push board support device of the present invention. The device comprises leg press member 11 affixed to an elongated board member 17. The leg press member 11 provides a means of support for the lower body, and specifically the feet of a user within a bed so as to press against the member 11 when shifting along a bed surface. The leg press member 11 engages the feet of a user, and therefore may take several forms and shapes to accommodate the user's comfort and ability to press thereagainst. In one embodiment, the leg press member 11 comprises a rounded structure. In yet another, preferred embodiment, the leg press member 11 comprises a hollow, elongated tube, whereby the tube is affixed to the board member 12 along its outer surface. Alternate embodiments of the leg press member include different shapes that accommodate the comfort and ergonomics of the user's feet, including foot impressions, different exterior shapes, and other designs that accept the arches of a user's feet. For the purposes of clarity, the leg press member will be herein referred to as a tube, comprising the preferred embodiment of the present invention.

The board member 12 of the present invention spans the length of the tube and extends outward therefrom such that the tube 11 is centered onto the board and is flanked by two outer board ends 17. The device is adapted to be placed across a bed width while the board ends 17 extend over the sides of the bed to engage a pair of opposing bed side rails. Most patient beds include upstanding side rails having open interior sections and rigid structures such that they can support a patient's weight. The ends 17 of the board are slid within the open interior of opposing side rails such that the device can operate as a sliding push support between the bed rails for a patient to exert lower body force thereagainst during bed movements. The board ends 17 bear against the side rails while the patient presses their feet against the outer surface of the tube 11, exerting stress on the assembly and bearing loads into the side rails.

The dimensions of the board, notably the board member 12 length and height 43, are important factors for proper fitment between patient bed side rails, where the dimensions of the given patient bed may be different between beds of different manufacture. The height 43 of the board 12 should be small enough to fit within the height provided between the top of the bed mattress and the upper interior portion of the open side rail structure, while its structure must be sufficient to absorb expected loads imparted thereon by the patient pressing his or her feet thereagainst. Similarly, the length of the board should be sufficiently long enough to extend beyond the extents of opposing side rails for stable support, whereby lateral movement of the board with respect to the side rails is accounted for and the board is prevented from easily dislodging from the side rails.

Figure 2:
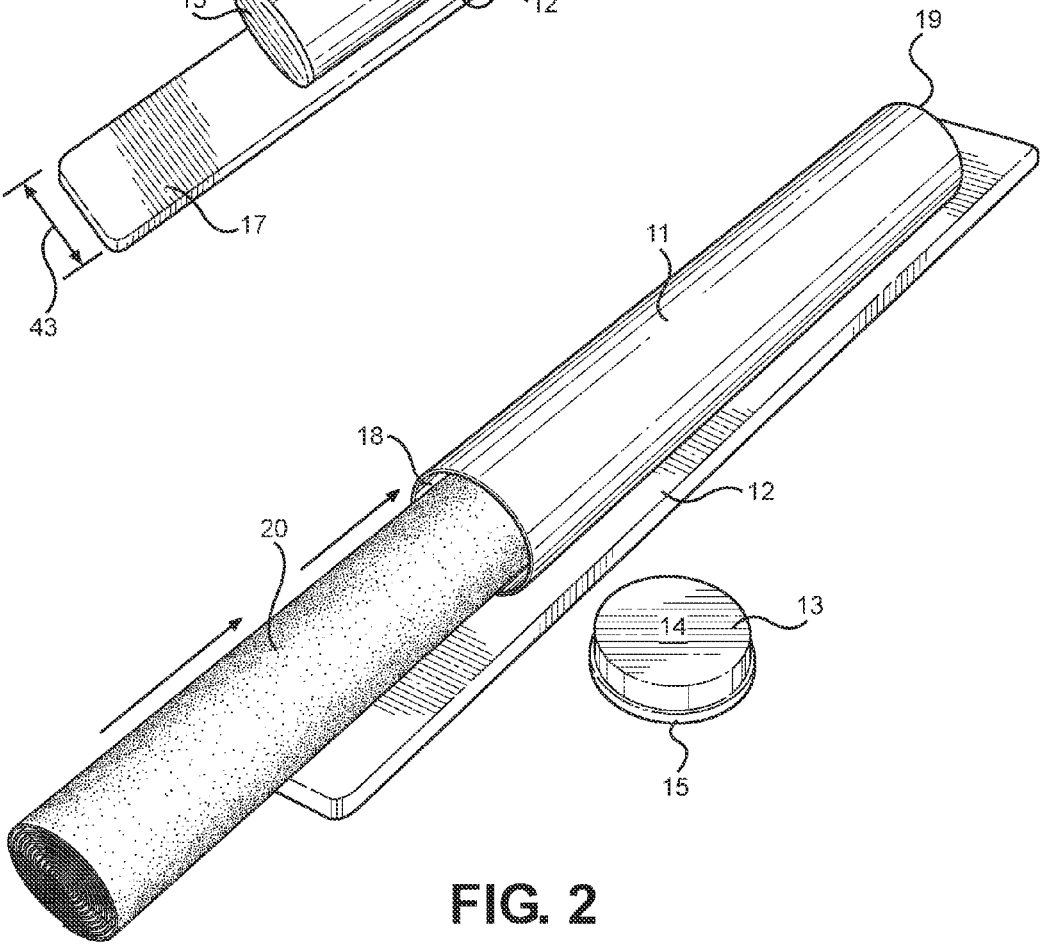
FIG. 2 shows a perspective view of the preferred embodiment, whereby the removable sheet is shown being inserted through the open first end of the elongated tube when the cap is removed.

Referring now to FIGS. 1 and 2, the hollow tube 11 is used as both a storage means and a structure for patients to brace themselves thereagainst. During movement, the user exerts their lower body against the tube 11 while moving along the bed surface. Between uses, the tube is also used as a storage means whereby articles can be placed within the interior of the tube 11. The tube 11 comprises an open first end 18 and a closed second end 19, whereby the first end 18 is open to allow placement of articles therethrough. Preferably, this storage location is utilized to stow a low friction sheet 20, whereby the sheet can be deployed as a sliding interface under the patient. The first end 18 of the tube 11 can be securely closed with a removable cap 13 when the device is in use or in transport. The preferred embodiment of the tube comprises a rounded structure that provides sufficient interior volume and sufficient structural integrity to prevent collapse under patient load. Together with the planar board structure, the assembly supports a patient exerting force against the outer surface of the tube 11 between the span of the bed rails.

The removable cap 13 protects contents stored in the tube 11. The preferred embodiment of the cap has an inner surface 14 that is recessed. The inner surface 14 has a diameter less than the inner diameter of the hollow, elongated tube 11. The removable cap 13 engages the tube with either a threaded or close tolerance, friction fitment to remain securely in place. The top edge 15 of the removable cap 13 has a diameter equal to the diameter of the hollow, elongated tube 11. The diameters are equal for the same dimension requirement necessary for proper fit of board 12 with the guard rails. Also, the top edge 15 prevents the removable cap 13 from insertion into the hollow, elongated tube 11. Although the removable cap 13 preferably uses a friction means for secure closure, other designs are also contemplated, including a threaded or hinged cap.

Figure 3:
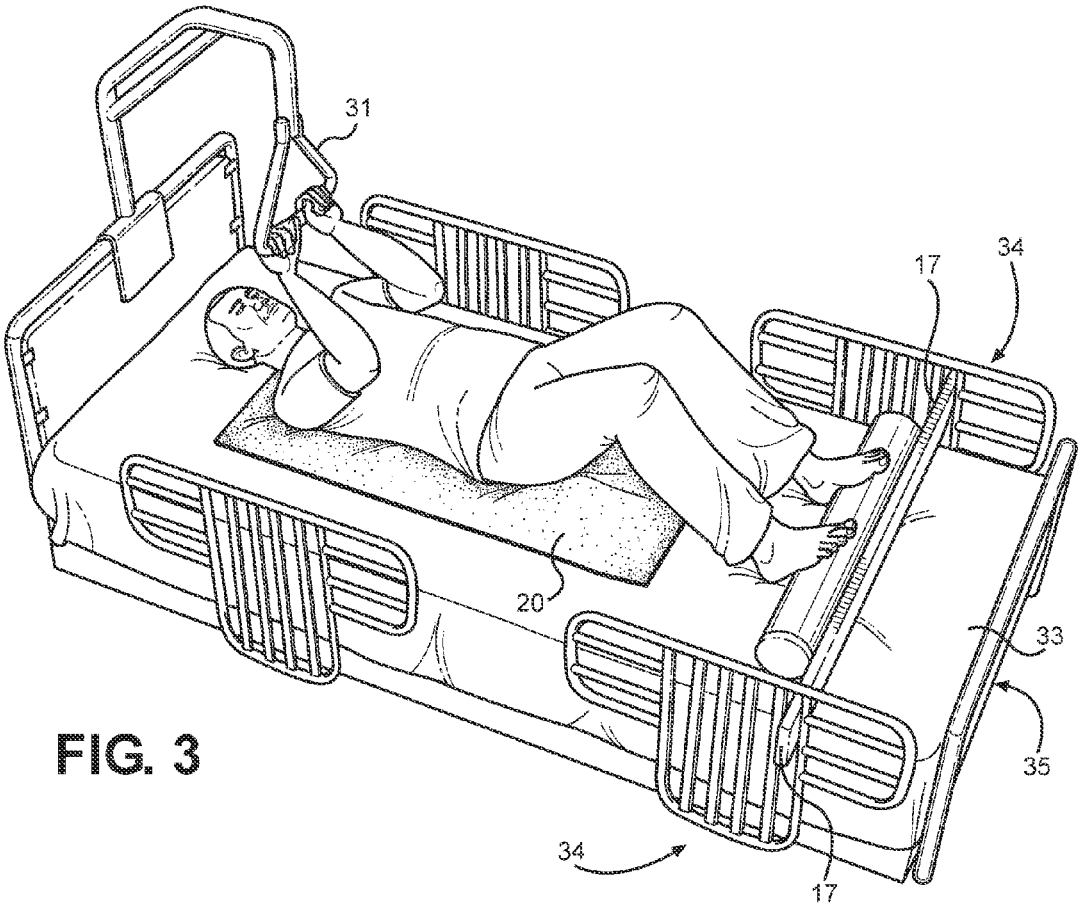
FIG. 3 shows a perspective view of present invention in its secured position on a patient bed while in use, while the low friction sheet is shown placed on the bed surface and below the individual. This view also shows the individual using a bed trapeze element for additional assistance.

Referring now to FIG. 3, there is shown a view of the push board device in a working state while in with a patient bed. The board ends 17 are placed with opposing bed side rails 34 such that the board spans the width of the bed 33 and is positioned just below the patient's feet. The board member of the present invention is situated such that the length of said board member is parallel to the end rail 35 of the patient bed. In a preferred method, the low friction sheet 20 is removed from the tube 11 interior and placed below the patient to assist in sliding along the bed 33 surface. To move within the bed, the patient presses his or her feet against the tube 11 outer surface, exerting force on the device to assist sliding. If an overhead trapeze element 31 is provided, the user can engage both the trapeze 31 and the push board assembly to assist in movements; however the board is designed to support the user's weight and any force exerted from the prone patient without any additional assistance.

The present invention utilizes the common structural design of a hospital bed. Generally, a hospital bed has side rails 34 that assist patients and caretakers moving and securing a patient within the bed. The side rail 34 are utilized to support the present invention as the patient presses against the tube 11 and the board ends exert bearing load on the side rails 34. The user, with or without the assistance of a trapeze 31, can utilize the present invention to limit or completely eliminate the need for assistance from another person when moving within the bed. Along with movement assistance, the device can be utilized as an exercise device for prone and bedridden patients, where the patient can gain strength in his or her lower body by pressing against the device and physically exerting themselves. This exercise slowing builds strength and improves overall health of the patient.

In most scenarios, a user will need assistance of another individual to properly set up the present invention and place the low friction sheet 20 on the mattress 33. The user, in a typical scenario, is rolled onto his or her side. Next, the low friction sheet 20 is placed where the patient will lie when the push board device of present invention will be used. The user is then moved onto the low friction sheet 20. Finally, the push board is placed in its secured position between side guard rails 34 on the bed. The push board device is aligned perpendicular to the user at the foot of the bed. Once installed, the patient user can utilize the device to move between prone and sitting positions, shift within the bed for comfort, assist themselves and caretakers when transferring out of the bed, and finally utilize the device as a strength building tool. While the patient lies on his or her back, he or she exerts force against the hollow, elongated tube 11. The force exerted enables the individual to move along the bed surface, while the optionally installed sheet 20 minimizes resistance to movement made by the individual and any bunching sheets on the bed.

Figure 4:
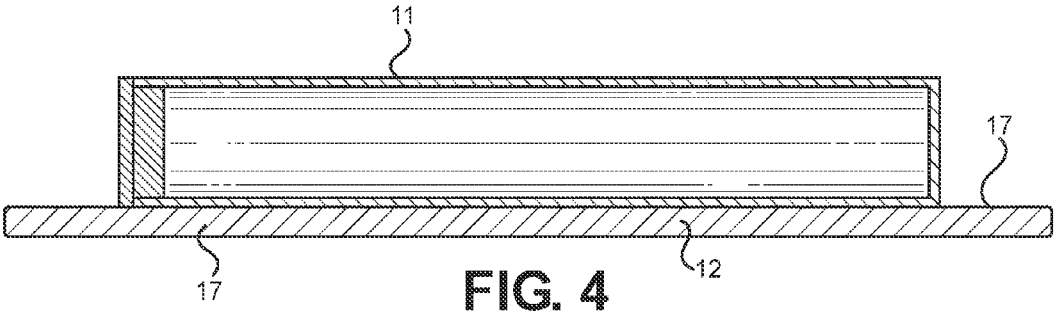
FIG. 4 shows a cross section view of the preferred embodiment of the present invention.

Referring finally to FIG. 4, is a side cross section view of the push board device of the present invention. The connection between the elongated tube 11 and the board member 12 is shown, whereby the two form an assembly for supporting the force exerted by a prone patient. The interior of the tube 11 is hollow to permit storage of articles therein, and preferably for storage of the low friction sheet that further assists a bedridden patient. In use, the board outer ends 17 are inserted within the side rails of a patient bed. Most side rails include an open interior structure, whereby the board ends 17 are placed thereagainst for support. If the interior structure does not provide vertical supports, a rounded tube 11 of the preferred embodiment compensates for any alignment issues with respect to the board 12 and the side rail support. If the board 12 is slightly angled, the patient is still provided the same rounded interface upon which to exert force thereagainst during bed movements.

Overall, the use of the present invention benefits the user in many ways. First, the present invention allows an immobilized person to gain some degree of independence. Such independence is beneficial to someone in hospice care or during extended periods of injury. The present support board helps a person move without assistance or supervision of another individual or caretaker. Second, the independent use of the present invention can help regain strength and muscle tissue that may atrophy during prolonged periods of bed rest. For example, the leg muscles may be strengthened by simulating leg press exercises, improving the patient's energy level and overall health in the long term. When deployed in conjunction with the low friction sheet, which helps mitigate discomfort and resistance during movements, the patient can quite readily move using only his or her lower body and without assistance. Finally, the present invention can be used when assisting a patient exiting the bed or transferring therefrom. The patient can brace themselves against the foot support, while also improve their overall ability to transfer by gaining lower body strength over time.

Associated with the device of the present invention is an accompanying method of patient treatment and movement while the patient is in a prone position. To assist movement and overall health, the patient utilizes the present push board device as a means to utilize their lower body and slide across the bed surface. The device is placed between opposing side rails of a patient bed along the foot region of the bed, such that the user can press one or both of his or her feet thereagainst for stable support when sliding. To further assist sliding, a low friction sheet is placed under the patient, preventing binding with sheets and resistance to sliding. The patient utilizes the board to shift within the bed, build strength, and assist transferring from the bed when necessary. Between uses, the device is easily removed from the side rails and stowed.

It is therefore submitted that the instant invention has been shown and described in what is considered to be the most practical and preferred embodiment. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A push board device for use with a patient bed side rails, comprising:

an elongated leg press member connecting to a planar board member;

said elongated leg press member comprising a tube structure with a hollow interior, a first open end, and a closed second end;

said first end having a removable cap to secure close said hollow interior;

wherein said board member length is parallel to a patient bed end rail;

said board member extending beyond said leg press member length such that said leg press member is centered on said board member and flanked by a first and second outer board end;

said board ends engaging opposing bed side rail structures along a foot end of a patient bed such that said board member extends laterally across said bed width and said leg press member is directed toward said bed head end;

said leg press member and said board member having sufficient stiffness and material strength to support a patient pressing against said rounded member with said patient lower body.

2. The device of claim 1, wherein said elongated leg press member further comprises a rounded outer surface.

3. The device of claim 1, wherein said hollow interior further comprises sufficient volume to support a low friction sheet therein, wherein said sheet is deployable beneath a patient to provide a low friction sliding interface between said patient and said bed surface.

4. A method of facilitating patient movement along a bed surface and improving patient strength, comprising the steps of:

placing a push board member across a patient bed width at said patient foot region such that said push board member length is parallel to a patient bed end rail;

using said patient bed side rails as bearing support for said push board member;

utilizing a push board member having a planar board member affixed to a hollow tube member between said bed side rails;

directing said tube member toward said patient bed head end to accept a patient's feet thereagainst;

pressing said patient's lower body against said push board member to move along said patient bed surface.

5. The method of claim 4, further comprising the steps of:

utilizing a push board member having a planar board member affixed to a leg press member between said bed side rails;

directing said rounded member toward said patient bed head end to accept a patient's feet thereagainst.

6. The method of claim 4, further comprising the steps of:

deploying a low friction sheet between said patient and said patient bed prior to movement to reduce resistance.

7. The method of claim 4, further comprising the steps of:

utilizing a push board member having a planar board member affixed to a rounded member between said bed side rails;

directing said rounded member toward said patient bed head end to accept a patient's feet thereagainst.

8. The method of claim 4, further comprising the steps of:

deploying a low friction sheet from within said tube member interior;

placing said sheet between said patient and said patient bed prior to movement to reduce resistance during movement of said patient.

* * * * *